US005553443A

United States Patent [19]

St. Clair et al.

[11] Patent Number: 5,553,443

[45] Date of Patent: Sep. 10, 1996

[54] METHOD FOR CREATING STRINGS OF POCKETED COIL SPRINGS

[75] Inventors: Albert R. St. Clair, Lilburn; Paul H. Brannock, Duluth, both of Ga.

[73] Assignee: Simmons Company, Atlanta, Ga.

[21] Appl. No.: 461,111

[22] Filed: Jun. 5, 1995

Related U.S. Application Data

[62] Division of Ser. No. 304,921, Aug. 15, 1994.

[51] Int. Cl.[6] ..... B65B 9/06; B65B 63/02; B65B 63/08

[52] U.S. Cl. ..... 53/450; 53/438; 53/440; 53/DIG. 2

[58] Field of Search ..... 53/438, 450, 114, 53/550, 127, 440, DIG. 2; 5/477; 267/89, 91

[56] References Cited

U.S. PATENT DOCUMENTS

| | | | |
|---|---|---|---|
| 1,867,872 | 7/1932 | Bronstein | 53/114 |
| 1,915,264 | 6/1933 | Schneider et al. | 53/114 |
| 2,663,475 | 12/1953 | McInerney et al. | 53/114 |
| 3,229,442 | 1/1966 | Gram | 53/450 |
| 3,312,453 | 4/1967 | Willard et al. | 53/114 X |
| 3,891,823 | 6/1975 | Dulude et al. | 267/91 X |
| 4,439,977 | 4/1984 | Stumpf | 53/428 |
| 4,565,046 | 1/1986 | Stumpf | 53/114 |
| 4,578,834 | 4/1986 | Stumpf | 5/477 |
| 4,876,842 | 10/1989 | Ausnit | 53/450 X |
| 4,986,518 | 1/1991 | Stumpf | 267/91 |
| 5,040,255 | 8/1991 | Barber | 5/477 |
| 5,303,530 | 4/1994 | Rodgers | 53/114 |

*Primary Examiner*—Linda Johnson
*Attorney, Agent, or Firm*—Jones, Day, Reavis & Pogue

[57] ABSTRACT

A method and apparatus for manufacturing mattresses, including the steps of forming a coil spring from wire, conditioning said coil spring to reduce stresses formed therein, placing said coil spring within pockets to create elongate strings of pocketed coil springs, attaching said elongate strings to create innerspring constructions.

6 Claims, 8 Drawing Sheets

METHOD FOR CREATING STRINGS OF POCKETED COIL SPRINGS

This is a divisional of copending application Ser. No. 08/304,921 filed on Aug. 15, 1994.

BACKGROUND OF THE INVENTION

1. Field of the Invention

This invention relates in general to bedding, namely, mattresses and box springs. More particularly, this invention relates to a method for creating strings of pocketed coil springs for subsequent use in mattresses or box springs.

2. Description of Related Art

It is known to form wire into individual coil springs and to combine such coil springs into a single innerspring unit which may be used as a mattress or as a box spring.

It is also known to provide individually "pocketed" coils and to assemble such pocketed coils into innerspring constructions for later upholstery into mattresses or box springs. An example of a method and apparatus for assembling such pocketed coil springs is shown in U.S. Pat. No. 4,439,977 to Stumpf, which is incorporated herein by reference. Methods and apparatus for combining groups of pocketed coils into a unitary string or array of coils for installation as innerspring units within a mattress assembly as illustrated in U.S. Pat. Nos. 4,578,834, and 4,986,518 which also are incorporated by herein reference.

Although the above systems provide several advantages over prior constructions, a need for improvement still exists. For example, when coils are compressed for insertion into pockets as shown in U.S. Pat. No. 4,439,977, the coils may tend to "set" resulting in a disadvantageous permanent height or load loss. Disadvantages also exist in that the wire tends to undergo certain stresses during formation which may cause residual faults in the coil springs.

Therefore, a need has been recognized in the industry to provide springs which do not exhibit stress induced problems including disadvantageous "set" conditions.

General heat treatment of coil springs is known. For example, it is known to provide "open-coil" innerspring constructions, and then to place such open coil innerspring constructions into an oven for stress relief. However, in the instance of innerspring constructions of pocketed coils, such constructions do not lend themselves to oven-heating since, for example, the pocket fabric or the glue holding the pocketed coil springs together will degrade if subjected to high temperatures as will be encountered with oven heating.

Therefore, a need has been recognized to provide a method and apparatus for providing improved pocketed coils and innerspring constructions made therefrom and to the products produced thereby.

SUMMARY OF INVENTION

The present invention provides improved pocketed coils and innerspring constructions made therefrom, in which pocketed spring wire metal coil springs are heat treated or otherwise conditioned prior to their insertion into pocketing fabric in a manner such that inherent residual stresses in the spring wire are reduced to enable the durability and resilience of the coil springs to be maintained over an extended period of time. Particularly, the present invention relates to methods and apparatus for heat treating coil springs formed from wire, and subsequent insertion of such coil springs into pocketing fabric, as well as to the mattress products produced therefrom as well as the coil springs produced thereby.

With respect to requirements and materials transformation for reducing or fully eliminating undesirable residual stresses in the wire of a compression coil spring, it should be noted that such residual stresses in the wire of a compression coil spring are generally of two types, i.e., wire drawing residual stresses and coil formation residual stresses. Both types of stresses result from cold working of the metal in the spring wire.

With respect to wire drawing residual stresses, when the carbon steel wire is manufactured for a pocketed coil spring application it is cold drawn, for example, from hot rolled high carbon 1070 steel rod in diameters of 7/32" (0.21875") or ¼" (0.25"). These rods normally are reduced in diameter reduction dies until it reaches a wire diameter range of 0.068" to 0.094". The substantial cross-sectional area reduction resulting from this cold working strain (deformation) in the wire results in the build-up and retention of distinct types of residual stress patterns, including longitudinal stresses (parallel to the axis of the wire, tensile at the wire surface and compressive at the axis of the wire), radial stresses (essentially perpendicular to the axis of the wire and compressive at the axis), and circumferential stresses (which follow the same pattern as the longitudinal stresses).

With respect to coil formation residual stresses, when the wire is formed into a compression coil spring certain additional residual stresses are added to and are believed to alter the residual stresses already present in the wire from the wire drawing operation. These additional coil formation stresses resulting from this additional cold working result in additional differential plastic strain (deformation) in the wire and in the resultant build-up and retention of other types of residual stress patterns in the wire, which include compressive residual stresses (in the wire material located to the interior of the mean coil diameter), tensile stresses (in the wire material located to the exterior of the mean coil diameter), and torsional stresses, as the wire contained in the active convolutions of the spring contains some levels of torsional residual stresses, resulting from twisting of the wire as the helical convolutions of the coil compression spring wire were formed.

It has been know that the combination of the aforementioned wire drawing and coil formation residual stresses present problems in regard to compression coil spring performance, load carry, free height retention, set resistance, and fatigue resistance. Therefore, relief of this undesirable stresses is necessary.

In order to achieve stress relief of compression coil springs in pocketed coil products, mechanical plastic deformation may be selectively applied to provide a balance in stresses. However, preferably, heating is selectively applied to achieve a balance in stresses. These processes may be followed b cooling to permit safe insertion of the compression coil spring into the fabric pocket.

Residual stress reduction up to and including full relief of undesirable stress relief can be accomplished by a number of methods, including but not limited to selective mechanical cold working or the wire in the spring (such as shot peening), ultrasound treatment, laser heating, heating in a resistance furnace, induction heating, electrical resistance heating, forced hot air heating, or radiant heating. However, regardless of which method is used, those methods involving the application of heat are preferred over the other alternatives. Also, regardless of which method is used, a certain and specified heating temperature and time must be applied to the spring undergoing stress relief and, thereafter cooling must take place down below a specified temperature in order to permit the insertion of the coil spring into a fabric pocket without detrimental effects to the pocket and pocket fabric.

One preferred time/temperature process for relieving stress on coil springs is now discussed, and it should be noted that time is stated in intervals, and the described case, a single time interval is equal to 700 to 800 milliseconds. In the preferred process, the temperature of the spring is elevated to the range of between 420 degrees F. and 1333 degrees F., but preferably approximately in the narrower range of 500–700 degrees F. all within a single time interval is not enough to complete heat penetration and, thus, complete undesirable stress relief. Then a sufficient number of additional time intervals are required. In this case the means of achieving process function is to utilize 2, 3, 4, 5 . . . N time intervals. Provisions for each time interval to take place without slowing the production rate of the machine will merely require additional conditioning chambers and the appropriate amount of in-line space to accommodate these chambers.

Potential methods to achieve the cooling function, include but are not limited to recirculating oil bath cooling, recirculating water cooling, combination air/water mist cooling, compressed air vortex cooling, forced refrigerated air cooling, and forced ambient temperature air cooling. Forced air cooling is the preferred method for cooling. However, regardless of which cooling method is used, a certain and specified cooling temperature and time must be applied to the spring which has undergone stress relief and cooling of the spring must take place below a specified temperature in order to permit the insertion of the coil spring into a fabric pocket without detrimental effects to the pocket and pocket fabric.

One preferred time/temperature for the cooling process would be to reduce the spring to a temperature in the range of 0–730 degrees F. single time interval. If one time interval is not enough to achieve cooling to the desired temperature, then a sufficient number of additional time intervals may be required. In this case, the means of achieving this process function is to utilize 2, 3, 4, 5 . . . N time intervals. Provisions for each time interval to take place without slowing the production rate of the machine will merely require additional conditioning chambers and the appropriate amount of in-line space to accommodate these chambers.

As may be understood, it is necessary to follow the above-referenced processes with insertion of the stress relieved and cooled spring into a fabric pocket.

Therefore, it is an object of the present invention to provide an improved pocketed coil construction for use in an innerspring structures.

It is a further object of the present invention to provide an improved innerspring construction for use in a mattress or box spring.

It is a further object of the present invention to provide an improved method and apparatus for providing pocketed coil springs, in which the coil springs are conditioned to relieve stress therein, prior to being inserted into pocketing fabric.

It is a further object of the present invention to provide an improved method and apparatus for manufacturing pocketed coil springs, which is cost-efficient in operation, construction, and maintenance.

These and other objects, features, and advantages of the present invention will become apparent upon reading the following detailed description of the preferred embodiments of the invention when taken in conjunction with the drawing and the appended claims.

BRIEF DESCRIPTION OF THE DRAWINGS

FIG. 1A is a top plan view of the inventive apparatus. FIG. 1B is a front elevation view of the apparatus of FIG. 1A, and FIG. 1C is a side elevation view of the apparatus.

DETAILED DESCRIPTION OF PREFERRED EMBODIMENTS

Figure 1A:
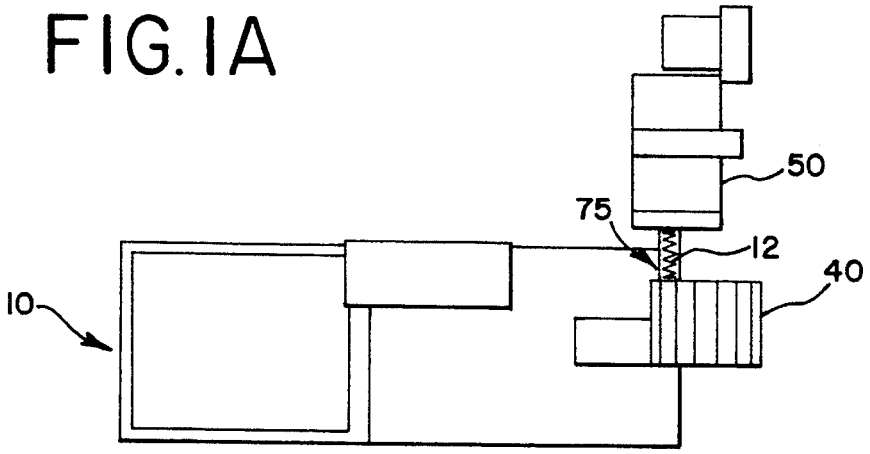
FIGS. 1A–1C are overall views of an apparatus embodying the present invention for use in the processes of the present invention.
Figure 1B:
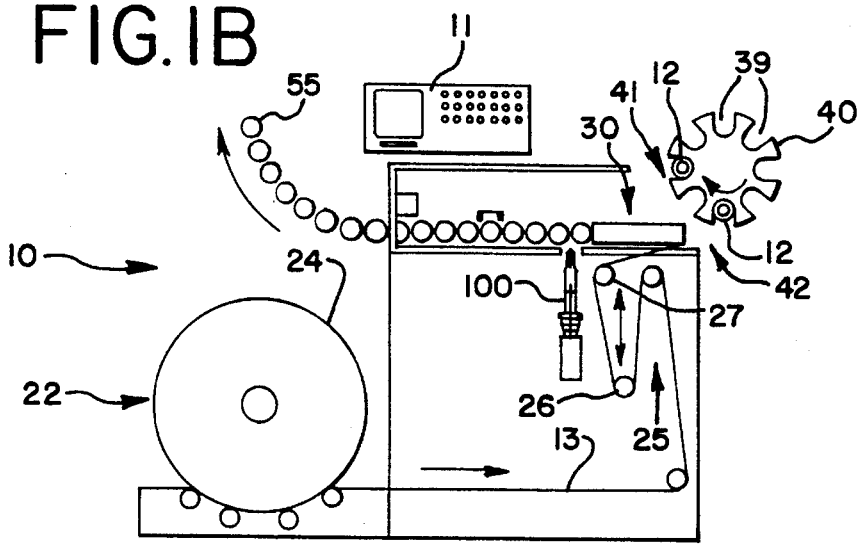
Figure 1C:
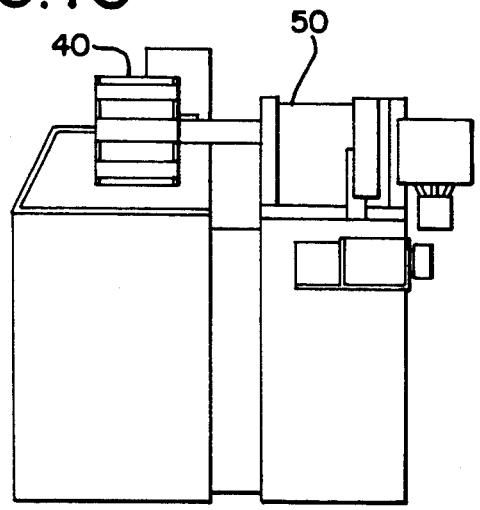

Referring now to the Figures, in which like numerals correspond to like items throughout the several views, FIGS. 1A–1C illustrate apparatus 10 according to the present invention, which includes a pocket material feed station 22 which feeds pocket material 13 from a roll 24 of synthetic or natural fabric along a path 25, around dancer rollers 26, to a coil conditioning carousel 40 (cover not shown in FIGS. 1A–1C) which is mounted for rotating motion and includes cavities 39 therein. Carousel 40 is positioned to accept unconditioned coil springs 12 at cavity insertion position 41 from a coiler head 50. These coil springs 12 are then conditioned, as discussed later in this application, and the conditioned coil springs 12 are deposited out of carousel 40 at cavity exit position 42 into a pocket forming station 30. A pocketed string 55 of coil springs 12 is then formed from these deposited, conditioned springs 12. A computer 11 is employed to control the operation of this process.

It will be understood that the coil conditioning carousel 40 periodically rotates in an intermittent fashion, with the carousel 40 periodically indexing at each machine cycle. For the carousel 40 shown in FIGS. 1A–1C, eight cavities 39 are present, so the carousel indexes eight times or "cycles" per each full carousel revolution. For the carousels 40 shown in FIGS. 2A–2C 3A–3C, 5A–5C and 6A–6C, twelve cavities are present, so these carousels index twelve times or "cycles" per each full carousel revolution. The cavities 39 of the conditioning carousel 40 may be lined with heat insulating material, if desired.

Figure 2A:
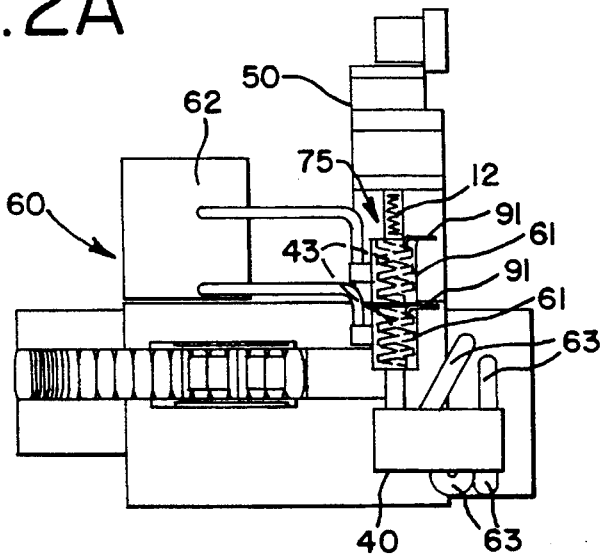
FIGS. 2A–2C are views of the apparatus of the present invention, FIGS. 1A–1C, further including an induction heating station used for heating a coil spring in accordance with this invention.
Figure 2B:
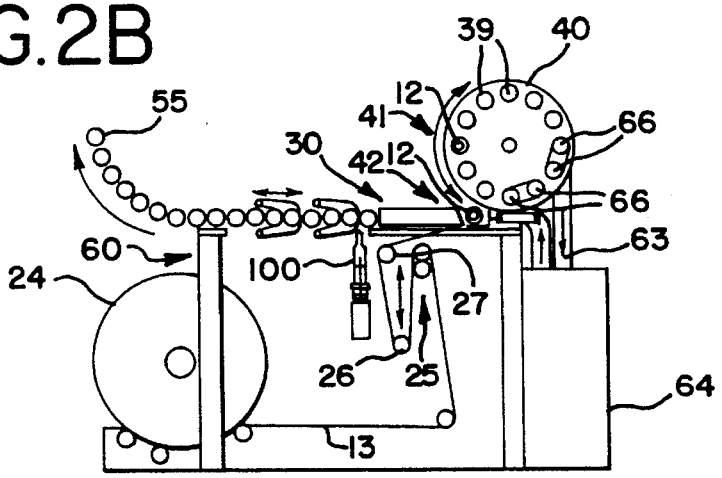
Figure 2C:
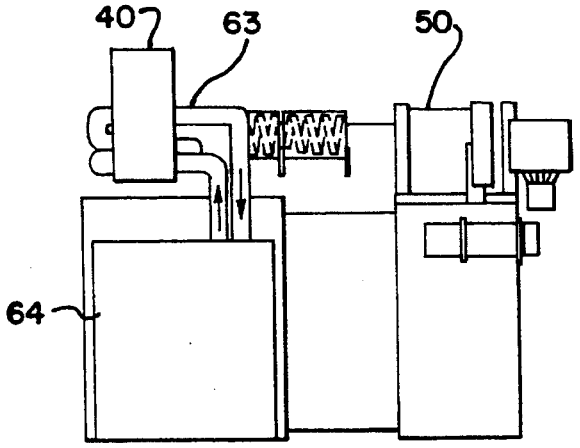

Referring now to FIGS. 2A–2C, an apparatus 60 for conditioning coil springs is illustrated which includes devices for induction heat conditioning the coil springs 12. As in FIG. 1, unconditioned coil springs 12 are provided from a coiler head 50. In the path 25 from the coiler head 50 to the coil conditioning carousel 40 as illustrated in FIGS. 2A–2C, each coil spring 12 is stopped for one cycle in at least one induction heating station or chamber 61. Each heating station 61 has an induction heating coil 43 therein. The induction coil 43 is supplied with high frequency current from a separate power supply 62. The high frequency current in the heating coil 43 produces a fluctuating magnetic field which induces current flow in each coil spring 12 as it is transported through station 61. The induced current provides rapid heating of each coil spring 12 to the desired temperature range of from about 500 degrees F. to about 700 degrees F., preferably about 600 degrees F.

After being heated by induction, the coil springs 12 are sequentially placed into the conditioning carousel 40, which in FIGS. 2A–2C is shown to include a cover. Cooling ducting 63 is provided to channel air to and from a cooling station 64. As discussed later in detail, the ducting 63 enables cooling air to be directed across one or more cavities 39 in the carousel 40, so that as a particular coil spring 12 is indexed along with the carousel 40, the coil spring 12 is cooled for at least one cycle. If more than one cavity is cooled as shown in FIGS. 2A–2C, the direction of the cooling air alternates for each cavity 39 due to the looped or turned-back configuration of the ducting 63 best illustrated in FIGS. 2C, 3C and 5C.

In each induction heating station 61, the coil springs 12 are passed axially along a path which essentially passes through the center of an induction coil 43. The induction coil 43 is configured to allow coil springs 12 to pass through its center without interference. In a preferred configuration of the induction coil 43 as best illustrated in FIG. 2A, the induction coil 43 has a throat dimension of about 5" inside diameter, is about 8" long, and has between 2 and 6 convolutions therein.

One method of positioning the coil springs 12 within the induction heating station 61 is by the use of nonconductive guide rods 71 (see FIGS. 4 and 9) which hold the coil springs 12 in place during the heating process. The guide rods 71 provide radial guidance of the coil springs as they travel along a longitudinal axis through the induction coil 43 and station 61. As in the case of radiant heating which will be discussed hereinafter, the coil springs 12 may be transferred along their path through station 61 via a blast of air provided by blower element 91.

Figure 3A:
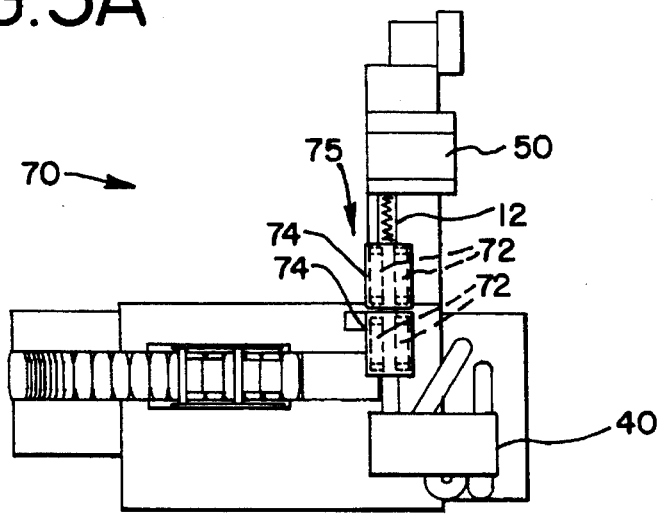
FIGS. 3A–3C are views of the apparatus of the present invention such FIGS. 1A–1C, further including a radiant heating station used for heating a coil spring in accordance with this invention.
Figure 3B:
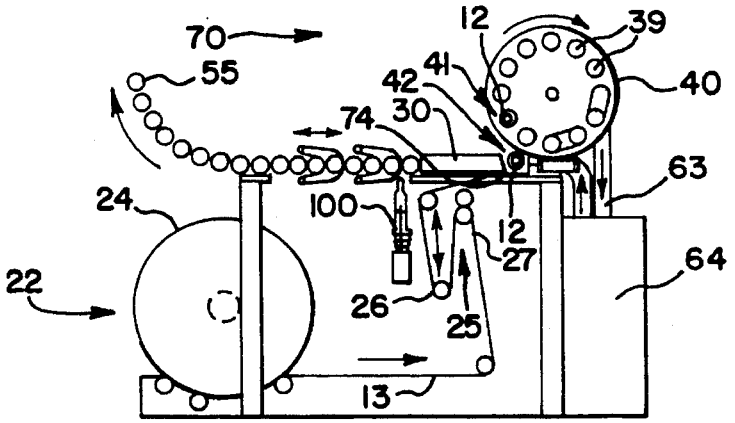
Figure 3C:
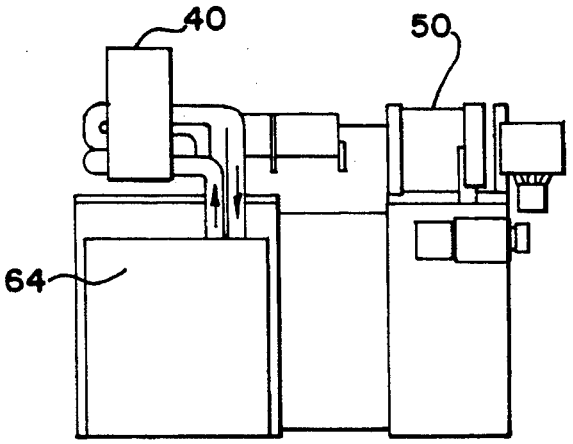

Referring now to FIGS. 3A–3C, an apparatus 70 for conditioning coil springs 12 is illustrated which employs radiant heat to condition the coil springs 12.

Figure 4:
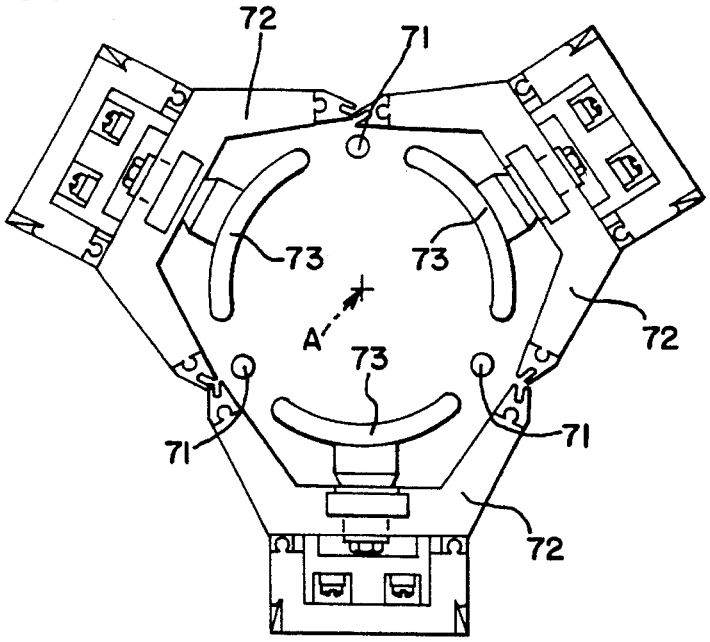
FIG. 4 is a cross-sectional view of a radiant heating assembly for use in the heating station illustrated in FIG. 3.

In the path 25 from the coiler head 50 to the coil conditioning carousel 40, coil springs 12 enter at least one radiant heating chamber 74 including electrically powered ceramic radiant heaters 72 (see also FIG. 4). The heaters 72 convert electrical energy into radiant energy at a frequency which yields efficient heat transfer to the coil springs 12. One or more radiant chambers 74 may be used in line to achieve the desired production rate with the coil 12 being heated to between about 500 degrees F. and about 700 degrees F., preferably about 600 degrees F.

As illustrated in FIG. 4, the coil springs 12 are conditioned by radiant heat treatment utilizing radiant heaters 72. As may be seen, three heaters 72 each include elongate radiant, ceramic, heating elements 73, which all face axis A, which is preferably the longitudinal axis of a spring coil 12 being heated. The length of the element 73 is preferably approximately equivalent to the longest coil contemplated for processing. Suitable heaters 72 for use herein are sold by Sylvania, as Model No. 066612.

Figure 9:
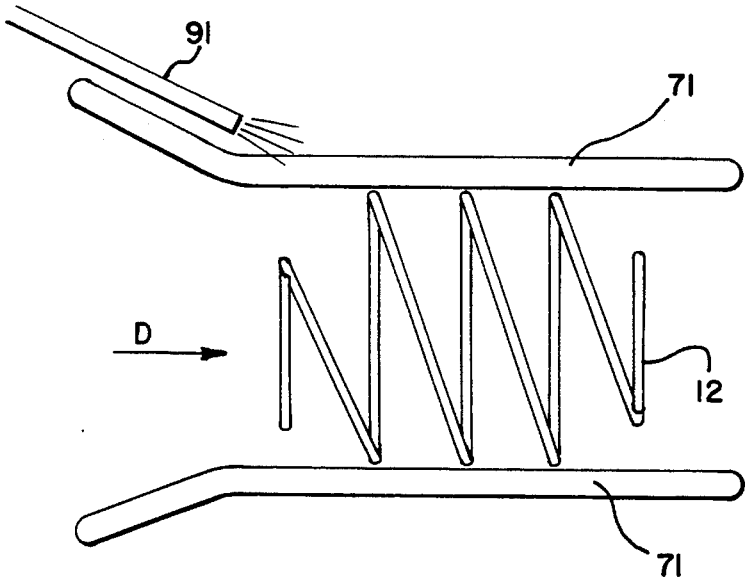
FIG. 9 is a side elevation view illustrating the operation of guidance rods in accordance with the present invention.

In a manner similar to that described above in regard to induction heating of the coil springs 12, insulative guide rods 71 as shown in FIGS. 4 and 9 may be used in moving the coil springs 12 through the heating chamber 74. Also, the previously discussed air blast transfer provided by blower member 91 may be employed, if desired.

After the coil springs 12 are heated, they are directed into the conditioning carousel 40 for soaking, cooling, and subsequent placement into pocketing fabric 13.

Figure 5A:
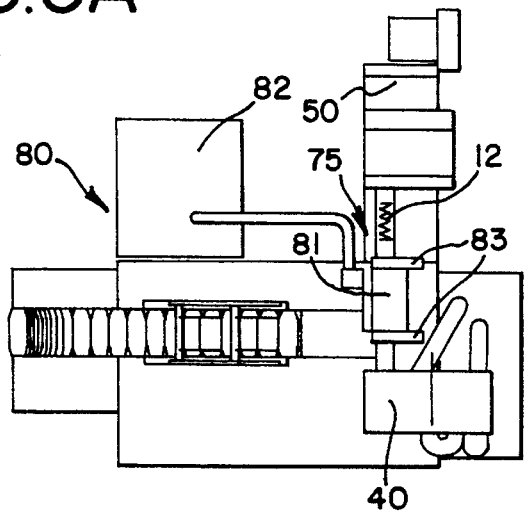
FIGS. 5A–5C are views of the apparatus of the present invention as illustrated in FIGS. 1A–1C, further including an electrical resistance heating station used for heating a coil spring in accordance with this invention.
Figure 5B:
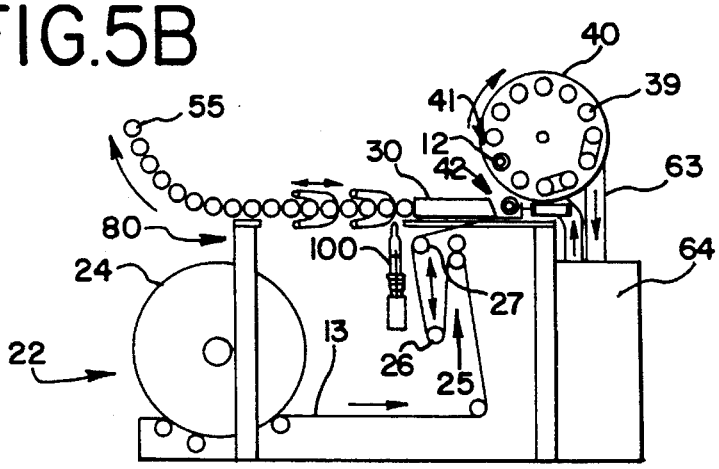
Figure 5C:
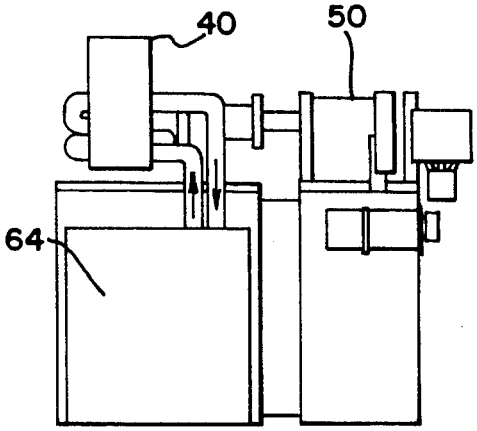

In FIGS. 5A–5C, an apparatus 80 for conditioning coil springs 12 is illustrated which uses copper or other contact plates 83 between which the coil springs 12 may be placed for heat conditioning the coil springs 12.

In the path from the coiler head 50 to the coil conditioning carousel 40, each coil spring 12 is stopped within an electrical resistance heating chamber 81, and copper contact plates 83 are pressed into contact with opposite ends of each coil spring 12. The contact plates 83 connect the coil springs 12 into an output circuit of a low voltage, high current power transformer 82. With contact fully established the power supply is energized for a brief period, typically 200 milliseconds or less. The high current will then flow directly through each coil spring 12 and will heat the coil spring 12 to between about 500 degrees F. and about 700 degrees F., preferably about 600 degrees F.

As previously discussed, the conditioned coil springs 12 are then sent to the carousel 40 and later placed into pocketing material 13.

Figure 6A:
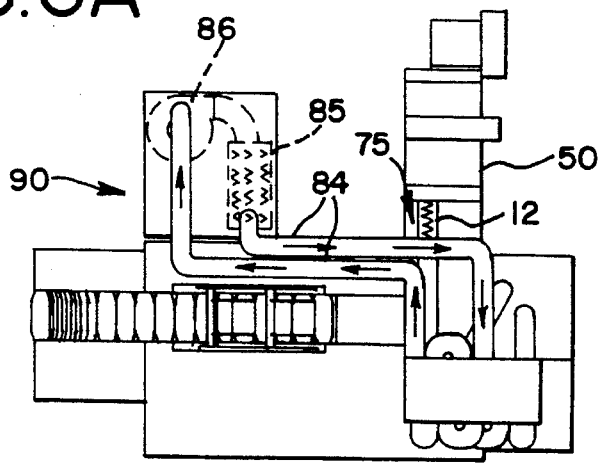
FIGS. 6A–6C are views of the apparatus of this invention such as illustrated in FIGS. 1A–1C, further including a forced air heating station used for heating a coil spring in accordance with this invention.
Figure 6B:
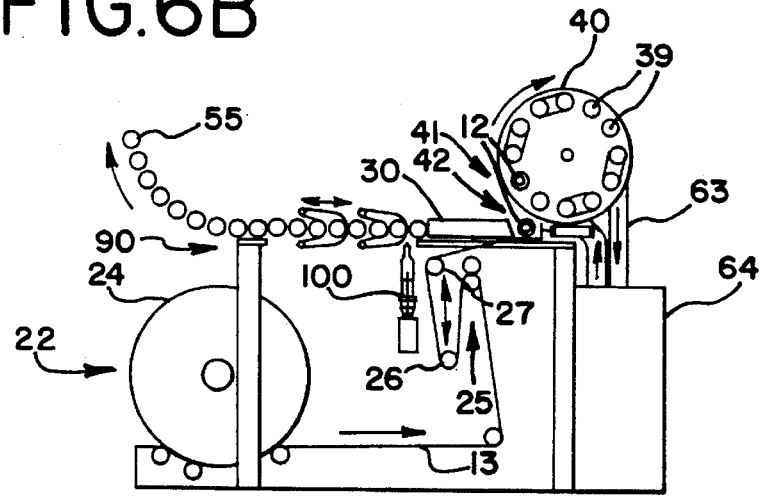
Figure 6C:
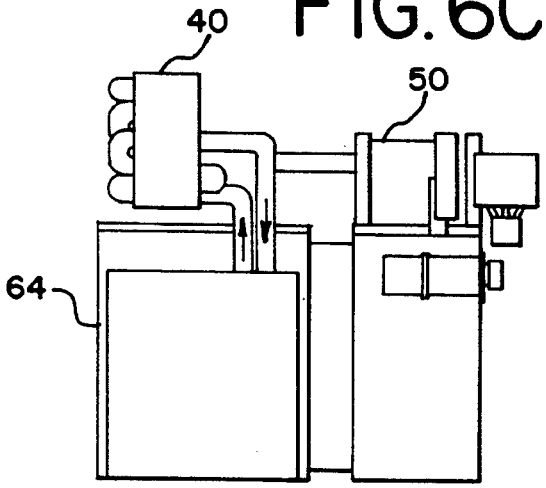

Referring now to FIGS. 6A–6C, an apparatus 90 for conditioning coil springs is also illustrated which includes the use of heated air to heat condition the coil springs 12.

In one embodiment of the present invention, after coil springs 12 leave the coiler head 50 ambient air from a blower 86 is heated to at least about 700 degrees F. by a heater 85 such as an electrical resistance heater, in a closed air stream. Then, the coil springs 12 are transported go into coil conditioning carousel 40. In the illustrated construction, heat ducting 84 guides heated air from air heater 85 through at least one cavity 39 of the carousel 40 to heat coil springs therein to between about 500 degrees F. and about 700 degrees F., preferably about 600 degrees F.

In a preferred embodiment of this invention, "soaking" of the coil springs is accomplished while just-heated coil springs are in the carousel but are not being cooled. The term soaking is used to describe the transfer of heat from the outer skin of the wire to the core of a wire, that is, the allowance of temperature gradients to be reduced across the cross section of wire strands. Typically, in preferred embodiments, this is done by allowing the coil springs to rest within a particular cavity without heat being transferred to or from the cavity by outside means. For example, in the configuration of FIGS. 2A–2C, the coil springs 12 may soak for up to 6 cycles before being cooled.

In accordance with the present invention, it is preferred that once a coil spring 12 has been heated to an appropriate temperature which may range from about 400 degrees F. to about 1300 degrees F., but normally will be in a range of between about 500 and about 700 degrees F. employing the preferred techniques as illustrated in FIGS. 2–6 herein and as described in accordance with this detailed description of the invention, the coil spring 12 must be cooled to a temperature which will allow the coil spring 12 to be inserted in pocketing material 13 without causing damage to the fabric structure. Thus, in preferred embodiments of this invention employing natural fabrics as the pocketing material 13, the coil springs 12 should be cooled to a temperature not exceeding approximately 150 degrees F. before they are inserted into the pocketing material 13. For certain synthetic fabrics, the spring coil cooling temperatures may be significantly higher than for natural fabrics and may range up to a temperature of about 700 degrees F.

The cooling of the coil springs 12 may be accomplished using a variety of cooling techniques including forced air circulation, recirculating oil baths, recirculating water, combination air/water mists, compressed air vortex cooling, forced refrigerated air cooling and the like.

For example, cooling of the coil springs 12 may suitably be achieved by employing ambient air which is pressurized, for example, to 10 inches water column pressure and then ducted to a series of chambers in the coil conditioning carousel 40. With high velocity, high volume air directed across the coil spring wires and due to the relatively low (typically 30 gram) mass of the coil springs 12, cooling can be achieved in four or less chambers. In the configuration shown in FIG. 2A–2C, the air is directed through four separate cavities 39, with air flow being redirected to in an opposite direction each successive cavity.

Figure 8:
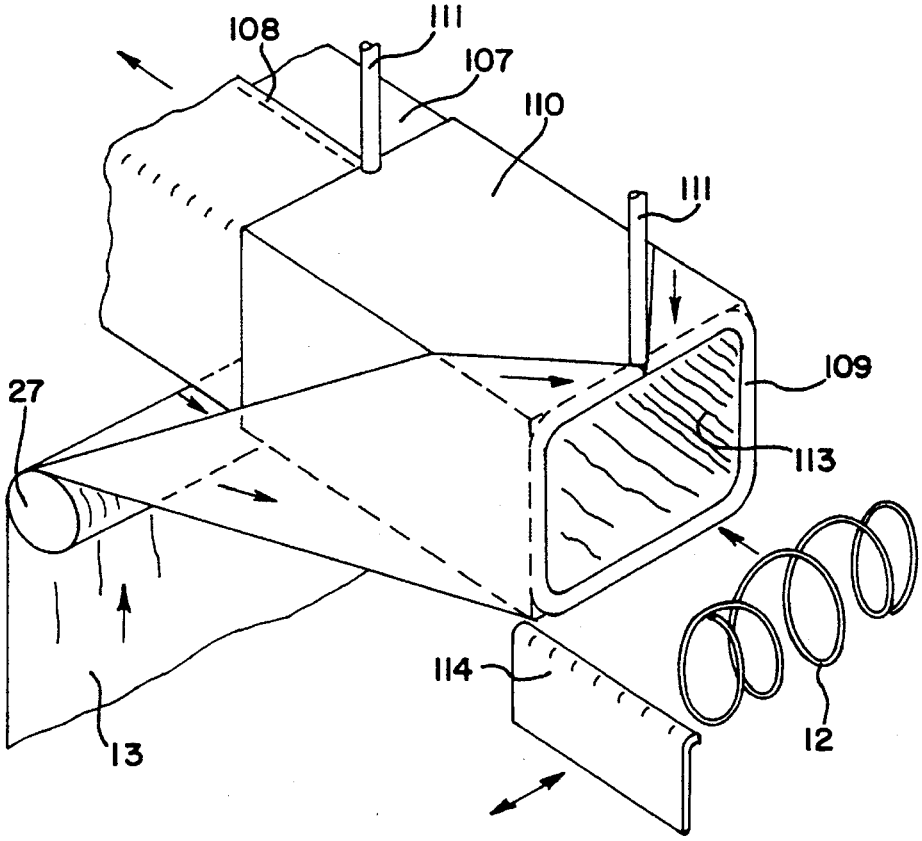
FIG. 8 is a pictorial view illustrating the operation of the forming tube utilized in accordance with the method of the present invention.
Figure 7:
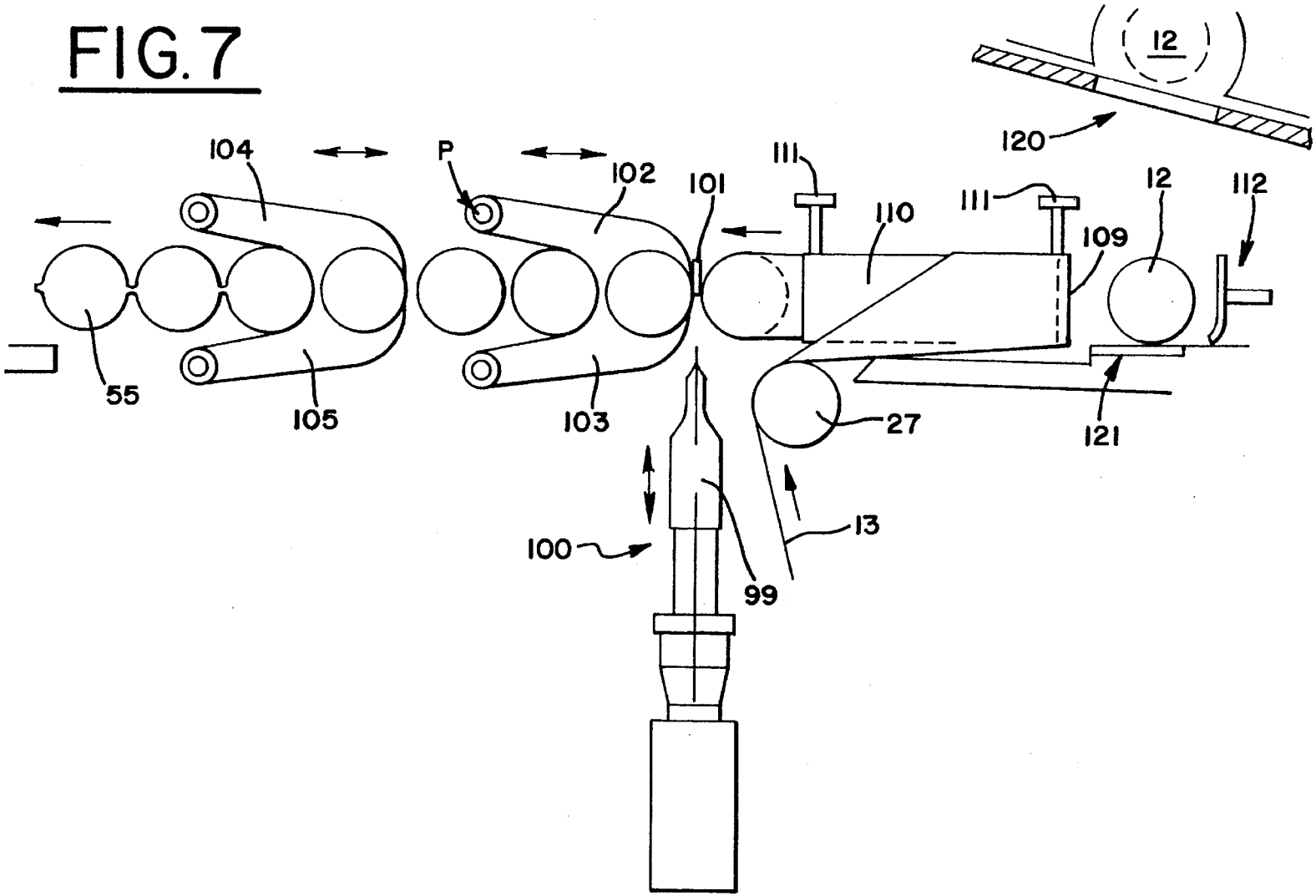
FIG. 7 is an isolated view of a pocketed coil indexing and welding apparatus employed in the present invention.

Reference is now made to FIGS. 7 and 8 for an understanding of the apparatus and process for inserting coil springs 12 into pockets defined by pocketing material 13. Generally, it should be understood that the process includes the steps of forming an elongate tube of fabric 107, inserting a coil spring 12 into the tube, and forming a pocket 123 around the coil spring 12, for example, by bonding as by ultrasonically welding, two seams 108 transverse to the longitudinal axis of the tube 107, one seam 108 on each side of the coil spring 12 to capture the coil spring 12 within the fabric pocket 123. By using two pairs of jaws 102, 103 and 104, 105, respectively, which serve to hold the coil springs 12 and fabric 13 in place for the welding process, and which serve to index the completed pocketed coil springs 124 out of the way to allow for a repeat of the process.

As shown in FIGS. 7 and 8, the fabric 13 is passed over an idler roller 27 (see also FIG. 1B), in substantially flat form. The fabric is then "gathered" around the outside of a forming tube 110 suspended by two rods 111, and including a leading mouth loop or forming ring 109. The fabric 13 is drawn through the tube 110 so as to create a fabric tube 107 at the exit or downstream mouth of the forming tube 110, with the free edges of the fabric overlapping in a flat seam at 108.

The loop or forming ring 109 is attached at the leading mouth of the forming tube, and provides smooth guidance of the fabric 13. Fabric 13 may be "gathered" to merge by guiding rollers (not shown), which may be of the spiked or deformable type as known in the art.

As previously discussed, the coil springs 12 are cooled in the conditioning carousel 40. At the end of each indexed rotation of the carousel 40, a conditioned coil spring 12 will be discharged as by falling under the influence of gravity, out of an exit hole 120 in the cover of the carousel 40. The metal coil spring 12 lands on a magnet 121, which holds it in place while a pair of synchronized compression side flaps 114 (only one shown in FIG. 8) come together to compress and center the coil while still atop the magnet 121. A reciprocating pushing element 112 driven by means known in the art pushes the coil off the magnet in a rolling fashion and into the throat of the fabric tube 107, itself in the throat of the forming tube 110.

The coil springs 12 are retained within the forming tubes 110 by friction between the ends of the coil springs 12 and the fabric 13. The fabric 13 is in frictional contact with the inwardly-directed vertical side surfaces 113 of the forming tube 110. A particular coil spring 12 is pushed into place by the pushing element 112 just after a previous coil spring 12 has been drawn or indexed downstream by a tensile force on the fabric tube 107. As will be discussed later, this tensile force is provided by a gripping action of jaws 102–105 positioned downstream of the forming tube.

There are two sets of jaws 102–105, a front set, and a rear set, which operate in synchronism. The front jaw set includes a front upper jaw 102 and a front lower jaw 103, which operate in synchronism. The rear jaw set includes rear upper jaw 104 and rear lower jaw 105, which operate in synchronism.

The front set of jaws 102, 103, combine to grip a particular coil spring 12, and the rear set of jaws 104, 105 combine to grip another coil spring 12 a number of coil springs downstream (three in the illustrated embodiment).

The jaws are similar, in that each is comprised of right and left side wall members mounted to opposing sides of a central "half-tube". When two jaws of a set come together as shown in FIG. 7, the two "half-tubes" come together to in effect "clamshell" a coil within fabric. This has an advantageous alignment effect. The rear jaw set provides additional tensile force during indexing.

Figure 10:
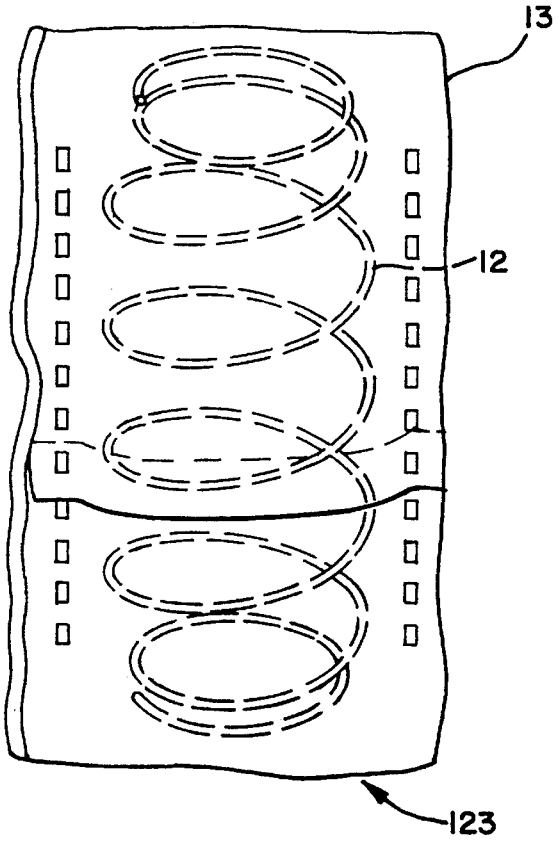
FIG. 10 is a schematic view illustrating the coil springs of the present invention inserted into a fabric defined pocket forming a part of an elongate string of such pocketed coil springs for use in producing an innerspring construction.

After a pair of coil springs 12 are gripped with the jaws in the positions shown in FIG. 7, the ultrasonic welding stack 100 including horn 99 is moved upwardly such that the overlapped tube of pocketing fabric 13 is "pinched" between horn 99 and an anvil bar 101 rigidly attached to the front lip of front upper jaw 102. The anvil bar 101 is "notched" to provide an intermittent transverse weld. The horn 99 is then ultrasonically energized such that the horn 99 and the anvil bar 101 combine to form an intermittent transverse thermal weld, which, when repeated, forms pockets 123 into which coil springs 12 are inserted to form the pocketed coil spring products 124 with coil springs 12 in pockets 123 formed from pocket material 13 as illustrated in FIG. 10.

After the welding process, the stack 100 is then withdrawn to its retracted position as shown in FIG. 7. A reciprocating carriage (not shown) holding the front and rear jaws 102, 103, 104, and 105 is then indexed by a suitable means such as a pneumatic cylinder to pull the entire coil string 55 just over one coil diameter in distance. In order that the process may be repeated, the jaws 102–105 are then returned to grip the next available coil spring.

Under one preferred embodiment, the steps of a) gripping, b) welding, c) indexing, d) release, and e) return occur in that order and in a single overall matching cycle.

Although stationary welding is described above, it should be understood that welding could be performed in a reciprocating manner "on the fly" by mounting the horn 99 onto the reciprocating carriage holding the jaws 102–105, which are pivotally mounted to the carriage at pivot points such as "P" in FIG. 7.

While this invention has been described in specific detail with reference to the disclosed embodiments, it will be understood that many variations and modifications may be effected within the spirit and scope of the invention as described in the appended claims.

What is claimed is:

1. A method for creating a string of pocketed coil springs, comprising the steps of:

a) forming a tube of fabric;

b) inserting a coil spring within said tube;

c) gripping said coil spring and said fabric with jaw members having generally semicylindrical surfaces structured and dimensioned to engage said coil spring and to enable wrapping of said fabric around said coil spring and envelop said spring with fabric;

d) welding a transverse seam across said tube of fabric to partially form a pocket in said fabric for containing said coil spring;

e) indexing said jaws to likewise index said spring and fabric; and f) releasing said jaws from said spring and fabric.

2. The method as claimed in claim 1, wherein in step "d", said welding is done by gripping said fabric intermediate an ultrasonic horn and an anvil attached to said jaw and energizing said ultrasonic horn to create a thermally welded seam in said fabric.

3. The method as claimed in claim 2, wherein in step "d", said welding completes a pocket around said coil spring.

4. The method as claimed in claim 1, wherein in step "d", said welding completes a pocket around said coil spring.

5. A method for creating a string of pocketed coil springs, comprising the steps of:

a) forming a tube of flexible fabric within a substantially rigid forming tube;

b) inserting a first coil spring within said tube of fabric and within said forming tube at a stationary point relative to said forming tube, such that the opposing ends of said first coil spring each bias against a layer of fabric which itself is biased against a corresponding wall of said forming tube;

c) pulling on and indexing said fabric downstream of said first coil spring such that said coil spring and said fabric are indexed together within said tube; and d) inserting a second coil spring within said tube of fabric and within said forming tube at said stationary point relative to said forming tube, such that the opposing ends of said second coil spring each bias against a layer of fabric which itself is biased against a corresponding wall of said forming tube.

6. A method for creating a string of pocketed coil springs, comprising the steps of:

a) forming a tube of fabric within a surrounding substantially rigid forming tube;

b) inserting a coil spring within said tube of fabric and within said rigid forming tube in a manner such that opposing ends of said coil spring are biased against said fabric tube and said rigid forming tube;

c) indexing said fabric tube with said coil spring therein through said rigid forming tube and causing said coil spring to exit from said rigid forming tube;

d) welding a first transverse seam on one side of said spring;

e) indexing said tube a second time; and f) welding a second transverse seam on the opposite side of said coil spring.

* * * * *